US008678103B2

(12) United States Patent
Miyuki et al.

(10) Patent No.: US 8,678,103 B2
(45) Date of Patent: Mar. 25, 2014

(54) DOZER APPARATUS

(75) Inventors: Shigeru Miyuki, Sakai (JP); Toshihiro Nakao, Izumi (JP); Masayuki Kawasaki, Wakayama (JP)

(73) Assignee: Kubota Corporation, Osaka (JP)

( * ) Notice: Subject to any disclaimer, the term of this patent is extended or adjusted under 35 U.S.C. 154(b) by 276 days.

(21) Appl. No.: 12/922,916

(22) PCT Filed: Mar. 9, 2009

(86) PCT No.: PCT/JP2009/054402

§ 371 (c)(1),
(2), (4) Date: Nov. 30, 2010

(87) PCT Pub. No.: WO2010/016292

PCT Pub. Date: Feb. 11, 2010

(65) Prior Publication Data

US 2011/0067892 A1 Mar. 24, 2011

(30) Foreign Application Priority Data

| | | |
|---|---|---|
| Aug. 4, 2008 | (JP) | 2008-200832 |
| Aug. 4, 2008 | (JP) | 2008-200833 |
| Aug. 4, 2008 | (JP) | 2008-200834 |
| Aug. 4, 2008 | (JP) | 2008-200835 |
| Dec. 11, 2008 | (JP) | 2008-315609 |

(51) Int. Cl.
*E02F 3/76* (2006.01)

(52) U.S. Cl.
USPC ..... 172/821; 172/813; 172/824

(58) Field of Classification Search
USPC ..... 172/813, 815, 819, 820, 821, 822, 823, 172/825, 818, 824; 37/231, 234
See application file for complete search history.

(56) References Cited

U.S. PATENT DOCUMENTS

| | | | | | |
|---|---|---|---|---|---|
| 2,224,725 | A | * | 12/1940 | Felt, Jr. | 172/823 |
| 2,308,535 | A | * | 1/1943 | Paulsen | 172/823 |
| 2,749,630 | A | * | 6/1956 | Nave | 172/821 |
| 2,753,638 | A | * | 7/1956 | Mork | 172/812 |
| 2,950,550 | A | * | 8/1960 | French | 172/821 |
| 3,083,480 | A | * | 4/1963 | Kirchler | 172/825 |
| 3,084,461 | A | * | 4/1963 | Beckford | 172/821 |
| 3,246,406 | A | * | 4/1966 | Ray, Jr. | 172/822 |
| 3,648,782 | A | * | 3/1972 | Mazzarins | 172/821 |
| 3,670,825 | A | * | 6/1972 | Asal et al. | 172/821 |
| 3,773,116 | A | * | 11/1973 | Coontz | 172/817 |
| 3,795,280 | A | * | 3/1974 | Casey | 172/812 |

(Continued)

FOREIGN PATENT DOCUMENTS

| | | | |
|---|---|---|---|
| JP | 61162639 | A | 7/1986 |
| JP | 07268909 | A | 10/1995 |
| JP | 2001164597 | A | 6/2001 |
| JP | 2006233641 | A | 9/2006 |

*Primary Examiner* — Jamie L McGowan
(74) *Attorney, Agent, or Firm* — The Webb Law Firm

(57) ABSTRACT

A traveling machine body 2 pivotally supports a dozer frame 3 via a horizontal shaft, the dozer frame 3 being lifted up/down via a dozer cylinder S1. This dozer frame 3 pivotally supports, via a vertical shaft Y, a support body 4 which is pivoted back and forth via an angle cylinder S2, and this support body 4 pivotally supports, via a fore/aft shaft Z, a blade 5 which is vertically pivoted via a tilt cylinder S3. The support body 4 supports the fore/aft shaft Z downwardly and forwardly of the vertical shaft Y, and the tilt cylinder S3 is disposed upwardly and forwardly of the vertical shaft Y and upwardly of the fore/aft shaft Z.

6 Claims, 12 Drawing Sheets

(56) References Cited

U.S. PATENT DOCUMENTS

| | | | | | |
|---|---|---|---|---|---|
| 3,822,751 | A | * | 7/1974 | Waterman | 172/821 |
| 3,926,263 | A | * | 12/1975 | Frisbee et al. | 172/825 |
| 4,013,132 | A | * | 3/1977 | Matsuzawa | 172/821 |
| 4,083,414 | A | * | 4/1978 | Yokoyama et al. | 172/821 |
| 4,221,267 | A | * | 9/1980 | Asal et al. | 172/821 |
| 4,249,323 | A | * | 2/1981 | Mathis et al. | 37/232 |
| 4,281,721 | A | * | 8/1981 | Beales | 172/821 |
| 4,337,837 | A | * | 7/1982 | Nissen | 172/822 |
| 4,364,439 | A | * | 12/1982 | Asal | 172/821 |
| 4,424,871 | A | * | 1/1984 | Stickney | 172/821 |
| RE31,642 | E | * | 8/1984 | Asal et al. | 172/821 |
| 4,828,044 | A | * | 5/1989 | Horsch et al. | 172/821 |
| 4,828,045 | A | * | 5/1989 | Horsch et al. | 172/821 |
| 4,848,483 | A | * | 7/1989 | Heiple | 172/821 |
| 4,893,683 | A | * | 1/1990 | Horsch et al. | 172/821 |
| 5,447,204 | A | * | 9/1995 | Asal et al. | 172/821 |
| 5,562,398 | A | * | 10/1996 | Knutson | 414/732 |
| 5,938,399 | A | * | 8/1999 | Knutson | 414/722 |
| 6,360,459 | B1 | * | 3/2002 | Brookhart et al. | 37/442 |
| 6,668,471 | B1 | * | 12/2003 | Cook et al. | 37/410 |

* cited by examiner

DOZER APPARATUS

TECHNICAL FIELD

The present invention relates to a dozer apparatus mounted to a work machine such as a backhoe, so as to effect a tilt-pivoting operation and an angle-pivoting operation.

BACKGROUND ART

In the conventional art of this kind, Patent Document 1, for instance, discloses a technique as follows. A dozer frame lifted up/down via a dozer cylinder is pivotally supported to a traveling machine body via a horizontal shaft. The dozer frame pivotally supports a support body which is pivotable back and forth ("fore/aft direction" hereinafter) via an angle cylinder. The support body pivotally supports a blade via a fore/aft shaft, the blade being vertically pivotable via a tilt cylinder. A vertical shaft is disposed to extend through the fore/aft shaft at a fore/aft center portion of this fore/aft shaft and the tilt cylinder is disposed upwardly of this vertical shaft.

Further, in Patent Document 2, a fore/aft shaft is disposed at a position lower than the blade, a vertical shaft attached to the blade extends through a front end of this fore/aft shaft, and a tilt cylinder is disposed upwardly of the blade.

Patent Document 1: JP 2001-164597 A

Patent Document 2: JP 61-162639 A

DISCLOSURE OF THE INVENTION

In the techniques of Patent Documents 1 and 2 described above, the vertical shaft is disposed to extend through the fore/aft shaft. Therefore, the overall length of the fore/aft shaft is large and it is difficult to secure sufficient shaft strength. Moreover, in the case of Patent Document 1, the distance from the fore/aft shaft to the tilt cylinder is short, so it is difficult to transmit the acting force of the tilt cylinder in an efficient manner. In the case of Patent Document 2, the tilt cylinder is disposed upwardly of the blade, thereby to increase the vertical height, which impairs the field of vision forwardly of the blade.

The object of the present invention is to provide a dozer apparatus capable of solving these problems of the prior art.

An object of the invention is to provide a dozer apparatus wherein a fore/aft shaft is supported downwardly and forwardly of a vertical shaft and a tilt cylinder is disposed upwardly and forwardly of the vertical shaft and also upwardly of the fore/aft shaft, so that the construction on the side of the rear face of the blade compact, while the overall length of the fore/aft shaft may be short and sufficient shaft strength can be ensured at the same time.

The above-noted object is fulfilled according to one aspect of a dozer apparatus according to the present invention as under namely:—

A dozer apparatus comprising:

a dozer frame supported to a traveling machine body to be pivotable about a horizontal shaft, the dozer frame being vertically movable by a dozer cylinder;

a support body supported to the dozer frame to be pivotable about a vertical shaft, the support body being pivotable in a fore/aft direction by an angle cylinder; and a blade supported to the support body to be pivotable about a fore/aft shaft, the blade being vertically pivotable by a tilt cylinder;

the support body supporting the fore/aft shaft downwardly and forwardly of the vertical shaft; and the tilt cylinder being disposed upwardly and forwardly of the vertical shaft and also upwardly of the fore/aft shaft.

In the above-described construction, preferably:— the support body includes arm portions projecting outward in a right/left direction and a sliding portion provided at the leading end of each arm portion and facing the blade;

in a rear face of the blade, there is provided a guide member that restricts forward departing movement of the blade while allowing vertical pivoting movement of the blade relative to the sliding portion; and the fore/aft shaft has an axis set lower than a vertical center of the sliding portion.

In the above-described construction, preferably:— the guide member includes an outer peripheral guide element engageable with an outer peripheral part of the sliding portion in a radial direction of the fore/aft shaft and an inner peripheral guide element engageable with an inner peripheral part of the sliding portion; and the inner peripheral guide element is disposed at such a position relative to the blade that the inner peripheral guide element becomes exposed from the support body to be attachable/detachable when the tilt cylinder is detached and the blade is vertically pivoted about the fore/aft shaft.

In the above-described construction, preferably:— a leading end of a cylinder rod of the tilt cylinder is connected to an upper portion of the blade, a bottom of a cylinder tube of the tilt cylinder is connected to an upper face of an arm portion of the support body, and a hydraulic hose connected to the cylinder tube of the tilt cylinder is caused to pass above the vertical shaft and to extend upwardly of a lateral portion of a dozer frame on a side remote from the cylinder tube in a right/left direction.

In the above-described construction, preferably:— the blade includes a rear face body supported to the fore/aft shaft and a blade main body fixed to a front face of the rear face body and covering an upper edge of the rear face body;

the tilt cylinder is disposed between the rear face body and the support body, and downwardly of an upper end of the blade main body; and to the rear face body, there is attached a cover member for covering the tilt cylinder from above, with a front edge of the cover member being disposed downwardly of an upper portion of the blade main body.

In the above-described construction, preferably:— to a rear face of the blade, a slide plate in slidable contact with the sliding portion of the support body is provided to be attachable/detachable to/from the guide member;

the guide member includes an outer peripheral guide element engageable with an outer peripheral part of the sliding portion in a radial direction of the fore/aft shaft and an inner peripheral guide element engageable with an inner peripheral part of the sliding portion; and the outer peripheral guide element and the inner peripheral guide element are fixed to the blade across the slide plate.

In the above-described construction, preferably:— the slide plate defines a lubricant oil passage;

a first oil supply member for supplying oil to the lubricant oil passage is provided in the arm portion of the support body; and a second oil supply member for supplying oil between the guide member and the arm portion is provided in the guide member.

With the above-described construction, when the angle cylinder is operated, the support body is pivoted back and forth or in the fore/aft direction (angle-pivoted) about the vertical shaft. When the tilt cylinder S3 is operated, the blade is vertically pivoted (tilt-pivoted) about the fore/aft shaft Z.

As the vertical shaft pivotally supporting the support body and the fore/aft shaft pivotally supporting the blade are formed separately from each other and the fore/aft shaft is disposed downwardly and forwardly of the vertical shaft, the shaft length can be reduced and sufficient shaft strength can be ensured at the same time.

Further, as the tilt cylinder is disposed upwardly and forwardly of the vertical shaft and also upwardly of the fore/aft shaft, the vertical dimension from the fore/aft shaft to the tilt cylinder can be shorter, thus making it possible to form the construction on the side of the rear face of the blade compact. In particular, if the tilt cylinder is disposed downwardly of the approximate upper end of the blade, the field of view forwardly of the blade can be further improved.

Further, during a tilt-pivoting operation by the tilt cylinder, the sliding portion provided at the leading end of the right/left arm portion of the support body is in engagement with the guide member while allowing vertical sliding movement of the blade, so that forward departing displacement of the blade can be restricted.

As the axis ZP of the fore/aft shaft Z is located lower than the vertical center of the sliding portion 4B, the load of the blade 5 when it is placed on the ground surface is supported by the face contact between the guide member 6 and the sliding portion 4B upwardly of the fore/aft shaft Z. Hence, one-sided abutment can be reduced and the face contact or abutment is realized, thus reducing fatigue (or uneven frictional wear).

As each right/left sliding portion 4B is used not only on the outer peripheral side but also on the inner peripheral side in a radial direction of the fore/aft shaft Z, and the outer peripheral side engages the outer peripheral guide element 6A provided in the rear face of the blade 5 and the inner peripheral side engages the inner peripheral guide element 6B, so that against the acting force applied when the blade 5 is placed on the ground surface or when the vehicle travels backward with placing the blade 5 on the ground surface (the force tending to move the blade 5 forwardly away from the support body 4), the support body 4 can sufficiently support the blade 5 at two, far and near positions in the radial direction of the fore/aft shaft Z.

Further, to the base plate 7 fixed to the rear face of the blade 5, the outer peripheral guide element 6A and the inner peripheral guide element 6B are detachably fixed via spacers 12, so that the outer peripheral guide element 6A and the inner peripheral guide element 6B can be attached in reversible manner on the right/left sides and/or front and back sides. Hence, when fatigue (or uneven frictional wear) has occurred, the elements can be reused with switching over the sides.

With the present invention, the overall lengths of the vertical shaft and the fore/aft shaft can be shorter and sufficient shaft strength can be ensured at the same time. Also, with the reduction in the vertical dimension from the fore/aft shaft to the tilt cylinder, the construction of the rear face side of the blade can be formed compact.

BEST MODE FOR CARRYING OUT THE INVENTION

Figure 1:
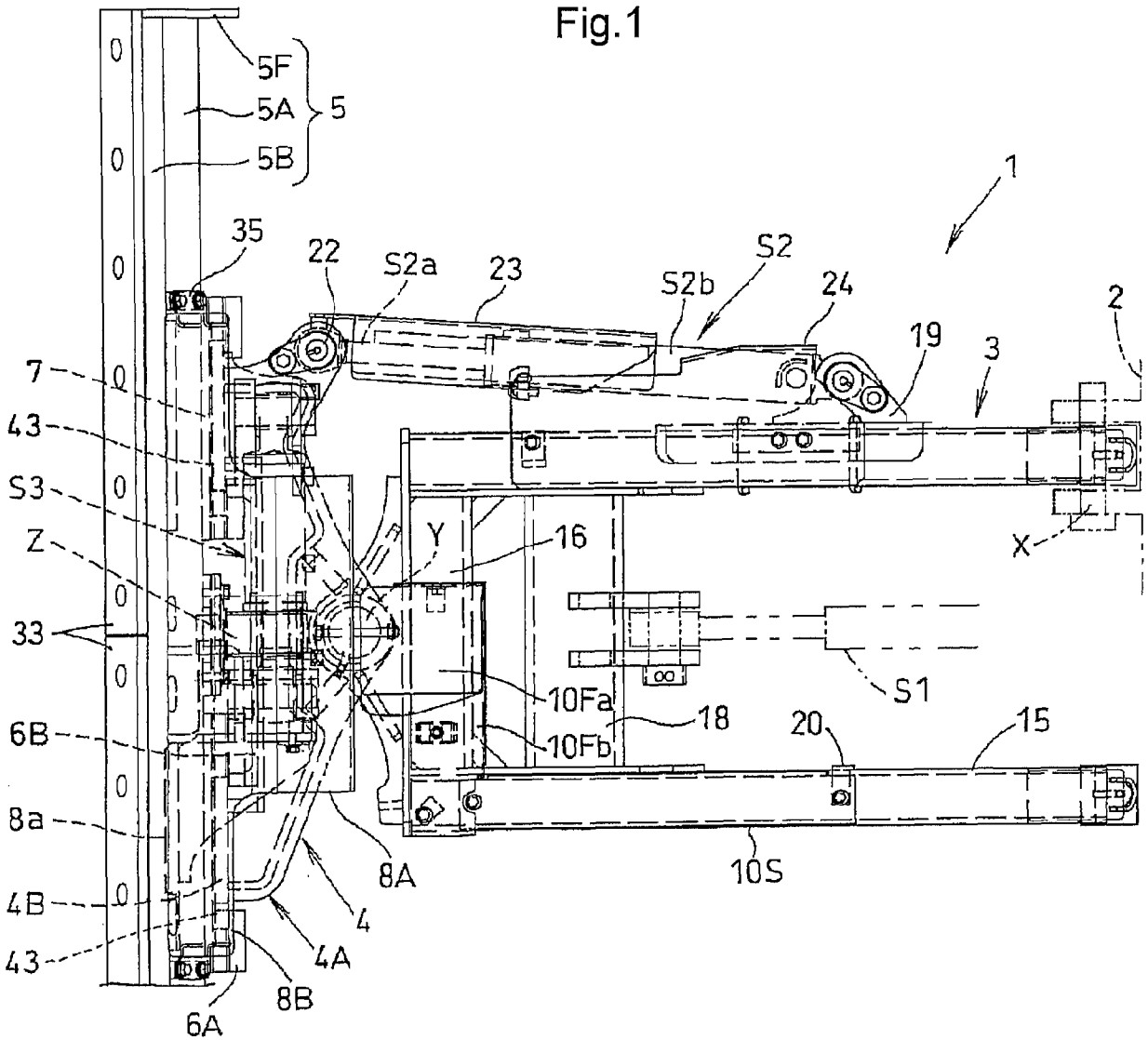
FIG. 1 is a general plan view showing an embodiment of the present invention.

An embodiment of the present invention will be described hereinafter with reference to the accompanying drawings.

In FIGS. 1 through 11, numeral 1 denotes a dozer apparatus called a tilt/angle dozer apparatus, which is mounted to a front portion of a traveling machine body 2 such as a backhoe.

Referring to the construction of this dozer apparatus 1, a traveling machine body 2 pivotally supports a dozer frame 3 via a horizontal shaft X. The dozer frame 3 is vertically movable as being pivoted by a dozer cylinder S1 about the horizontal shaft X. This dozer frame 3 pivotally supports a support body 4 via a vertical shaft Y (angle-pivotal shaft). The support body 4 pivotally supports a blade 5 via a fore/aft shaft Z (tilt-pivotal shaft). The blade 5 can be vertically pivoted (tilt-pivoted) as being pivoted by the fore/aft shaft Z by a tilt cylinder S3.

In FIGS. 1, 2, 4 and 6-9, referring more particularly to the dozer frame 3, front ends of a pair of right/left main members 15 elongate in the fore/aft direction are connected to each other via a front member 16. To the front portion of this front member 16, a vertical shaft receiving member 17 is fixed. Fore/aft intermediate portions of the main members 15 are connected to each other via a connecting member 18, to which member 18 a cylinder rod of a dozer cylinder S1 is connected. A bracket 19 is fixed to one (right main member) of the pair of right/left main members 15 and to this bracket 19, a cylinder tube of an angle cylinder S2 is pin-connected.

The main member 15 is an angular tubular body. The connecting member 18 is a cylindrical body and the front member 16 is a body having a one-side open square shaped cross section. The vertical shaft receiving member 17 is formed by fixedly attaching a front plate 17*a* to the front faces of the main members 15 and the front member 16, and also by fixedly attaching a pair of upper/lower plates 17*b*, each with an approximately triangular shape in plan view, to the front face of the front plate 17*a*, and by inserting and fixing a cylindrical body 17*c* to an apex each of the triangular plate 17*b* for allowing insertion of the vertical shaft Y into the body 17*c*.

On the outer side of one of the main members (right main member) 15, the angle cylinder S2 is disposed; whereas, on the upper side of the other (left main member), there are disposed a hydraulic hose 9 connected to the tilt cylinder S3 and a side hose cover 10S covering this hose 9, and there is also provided an attaching tool 20 used for fixing the hydraulic hose 9 in position and used also for attaching the side hose cover 10S.

The support body 4 is formed by connecting an upper plate 4*u* and a lower plate 4*d* via a front plate 4*f* and a rear plate 4*r* in the form of vertical plates, fixedly attaching upper/lower boss members 4*a* for allowing insertion of the vertical shaft Y to respective rear projecting portions of the upper plate 4*u* and the lower plate 4*d*, and fixedly attaching a fore/aft shaft receiving member 21 for pivotally supporting the fore/aft shaft Z to the lower plate 4*d*, the front plate 4*f* and the rear plate 4*r*.

Figure 2:
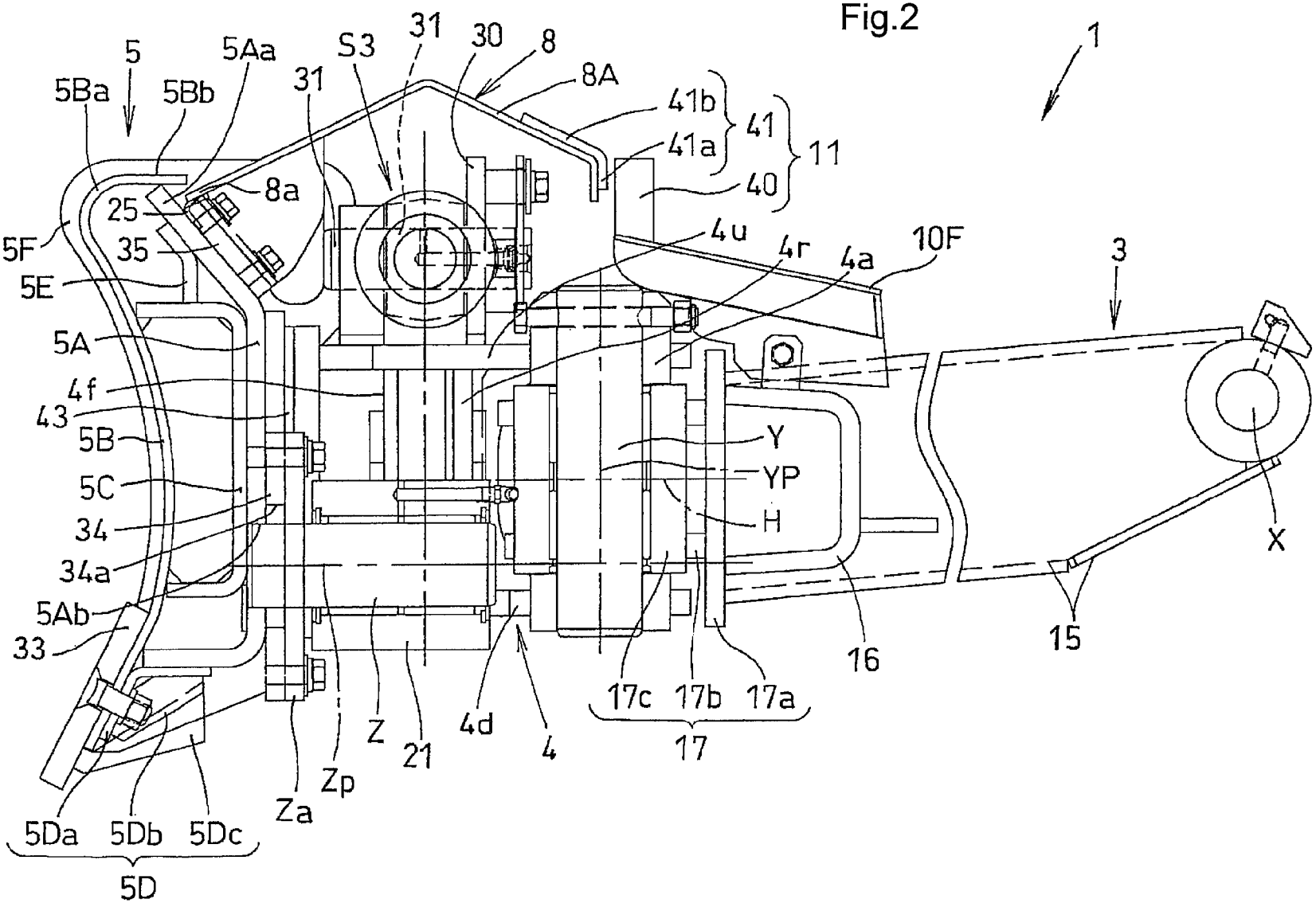
FIG. 2 is a general side view in section of the same.
Figure 3:
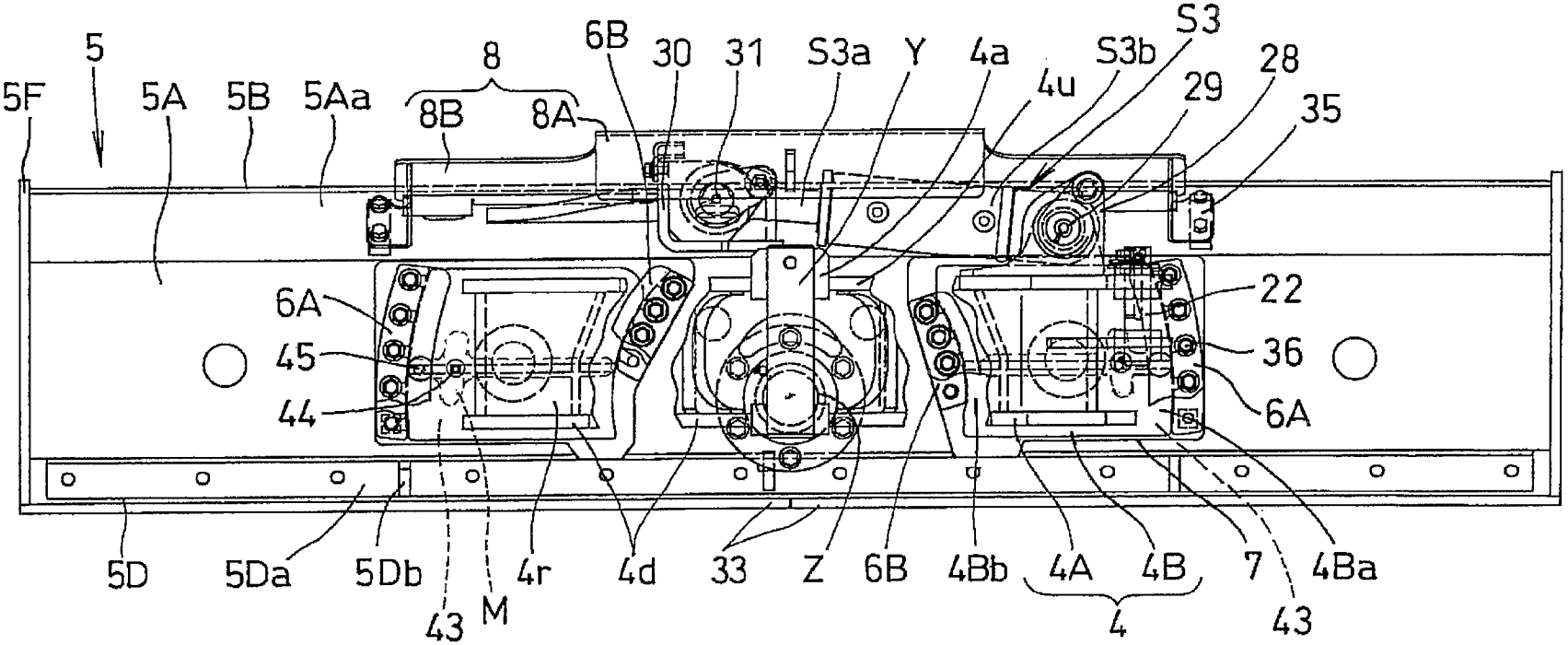
FIG. 3 is a rear view of a blade.
Figure 4:
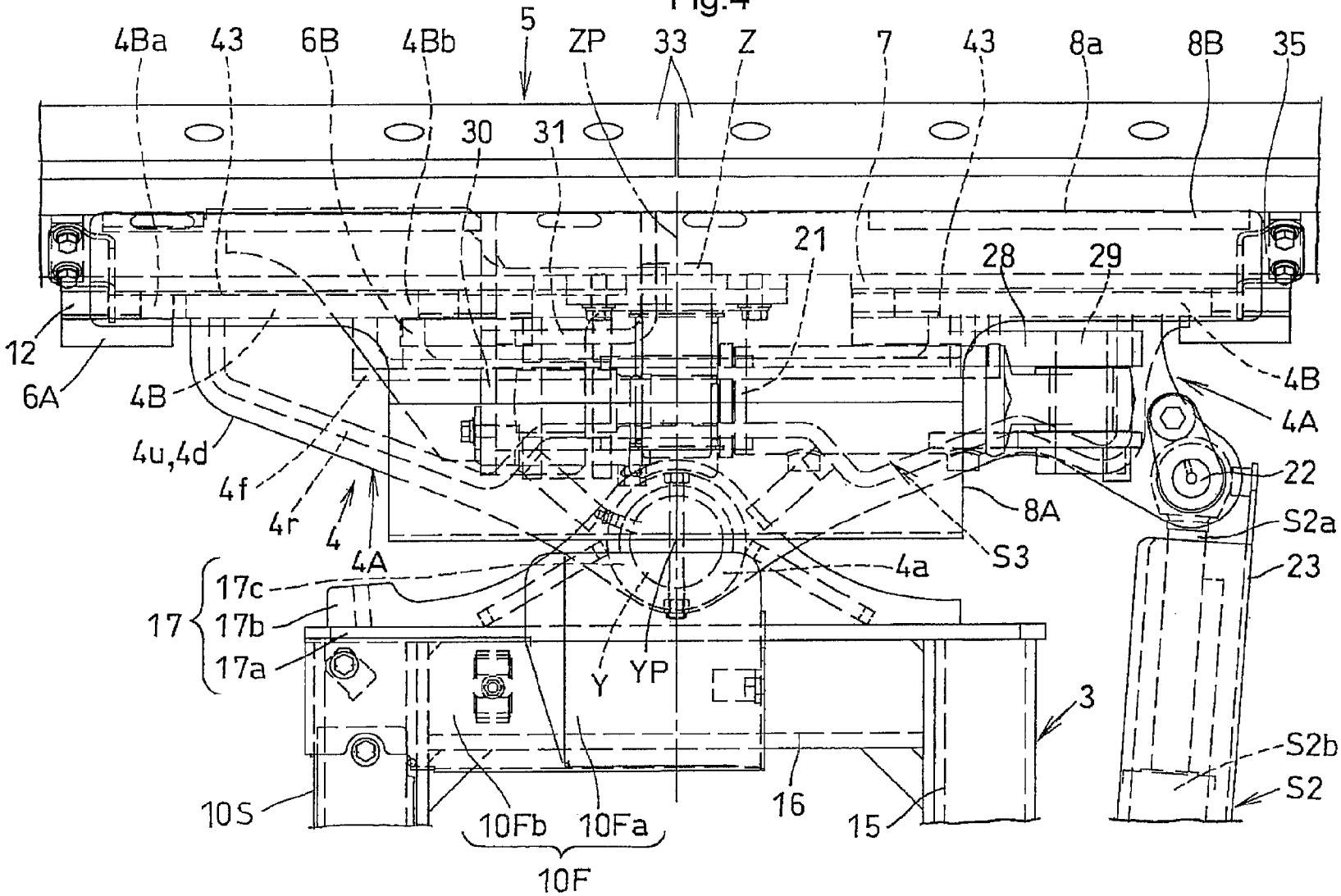
FIG. 4 is an enlarged plan view of principal portions.

As shown in FIGS. 2 and 4, the fore/aft shaft receiving member 21 is disposed forwardly of the lower boss member 4*a*, so that the fore/aft shaft Z is disposed forwardly of the vertical shaft Y, and an axis YP of the vertical shaft Y and an axis ZP of the fore/aft shaft Z are disposed on a common vertical plane. The axis ZP of the fore/aft shaft Z is disposed downwardly of a vertical center of the vertical shaft Y or a vertical center H of the cylindrical body 17*c* of the vertical shaft receiving member 17 and the fore/aft shaft Z is disposed adjacent and in opposition to the lower portion of the vertical shaft Y.

In FIGS. 1-9, referring to the support body 4, from its right/left center portion where the boss member 4*a* and the fore/aft shaft receiving member 21 are disposed, arm portions 4A project. An outer end front face of each of these right/left arm portions 4A projects forwardly and at this projecting end, a sliding portion 4B is formed.

Each one of the right/left sliding portions 4B is formed by fixedly attaching a flat plate to the front projecting end of the arm portion 4A. The front face of this sliding portion 4B faces the rear face of the blade 5 and an outer peripheral edge 4Ba and an inner peripheral edge 4Bb located away from the fore/aft shaft Z in the radial direction are formed in arcuate shape centering about the fore/aft shaft Z.

The outer end of the arm portion 4A of one (right) of the right/left arm portions 4A projects rearwardly, to which there is attached an angle pin 22 to which a cylinder rod S2*a* of the angle cylinder S2 is connected. To this cylinder rod S2*a* of the angle cylinder S2, a rod cover 23 is connected and is engaged with the cylinder tube S2*b* to be slidable along the longitudinal direction. In the angle cylinder S2, the cylinder tube S2*b* and a hydraulic hose connected thereto are protected by a tube cover 24 provided in the main member 15.

The angle cylinder S2 is pivotally supported at the fore/aft center portion of the dozer frame 3 or rearwardly thereof and is disposed laterally of the dozer frame 3. Therefore, even if a cylinder having a necessary and sufficient stroke is used, the angle pin 22 can be disposed close to the fore/aft position of the vertical shaft Y and the fore/aft dimension of the support body 4 can be made short.

Further, by rendering the internal angle formed by the angle cylinder S2 with the centerline interconnecting the vertical shaft Y and the angle pin 22 as close as possible to a right angle, the expansion/contraction force of the arm cylinder S2 can be transmitted to the support body 4 in an efficient manner.

In the support body 4, at an outer end upper face of the arm portion 4A of one (right) of the right/left arm portions 4A, there is provided a cylinder support body 28 and to this cylinder support body 28, the bottom of the cylinder tube S3*b* of the tilt cylinder S3 is pivotally supported via a base shaft 29. And, the leading end of the cylinder rod S3*a* of this tilt cylinder S3 is pivotally supported and connected via a connecting pin 31 to a rod support body 30 fixedly attached to the rear face of the blade 5.

The tilt cylinder S3 is disposed with an offset to one side (right side) from the right/left center of the support body 4 and the rod support body 30 is disposed with an offset to the opposite side to the disposing side of the tilt center from the right/left center at the upper portion of the rear face of the blade 5 and the cylinder rod S3*a* is disposed directly above the fore/aft shaft Z.

Figure 5:
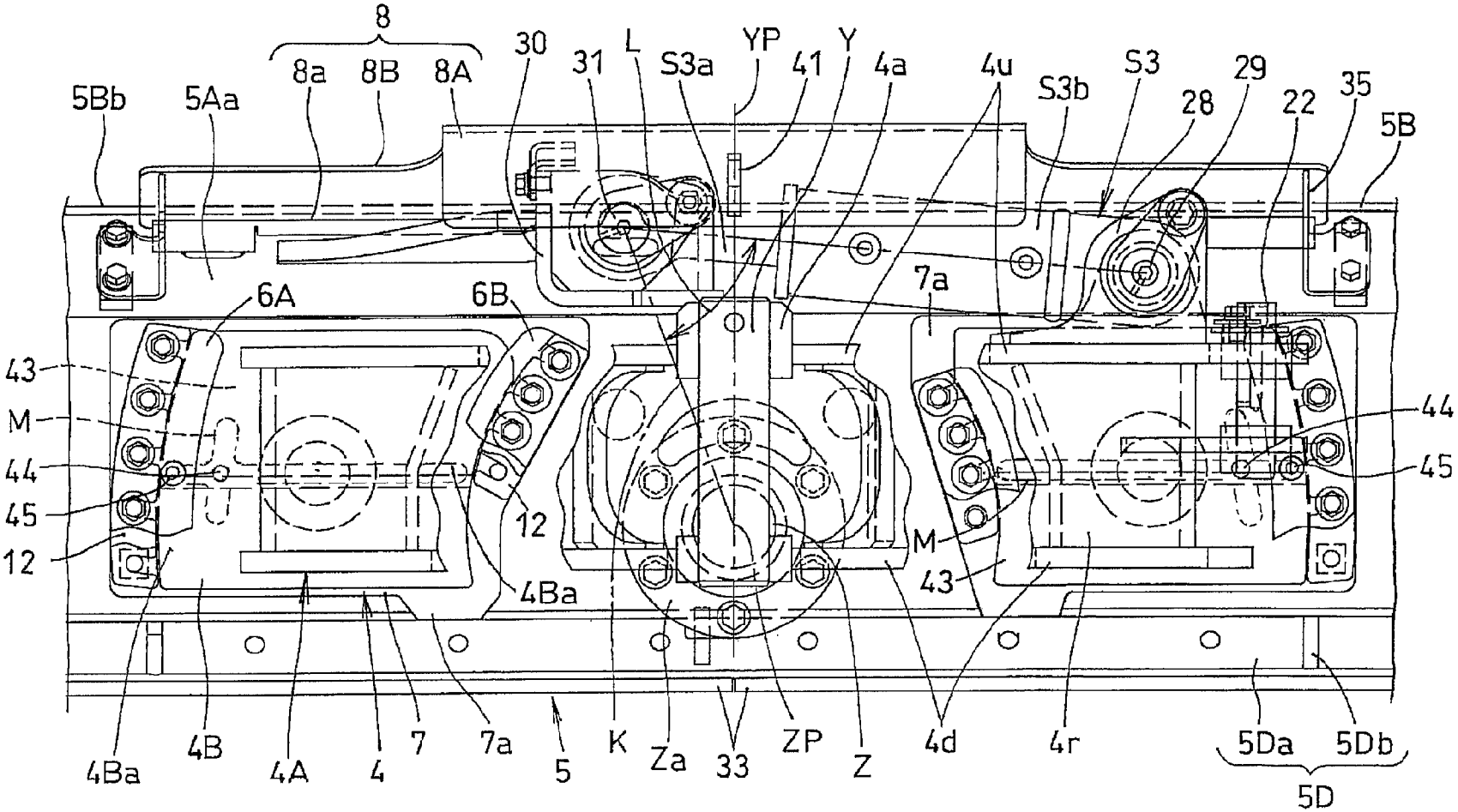
FIG. 5 is an enlarged rear view of principal portions.
Figure 6:
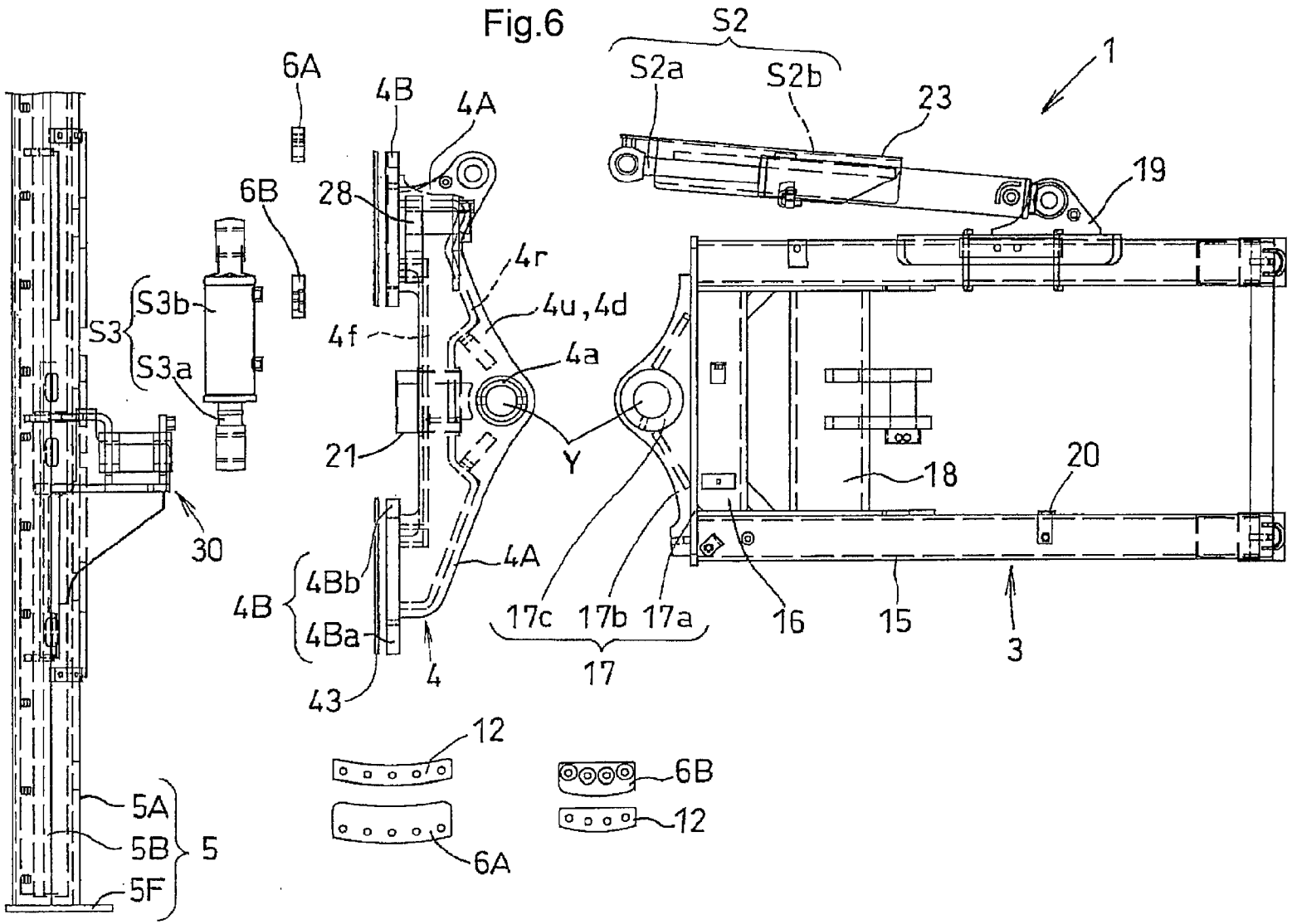
FIG. 6 is an exploded plan view.
Figure 7:
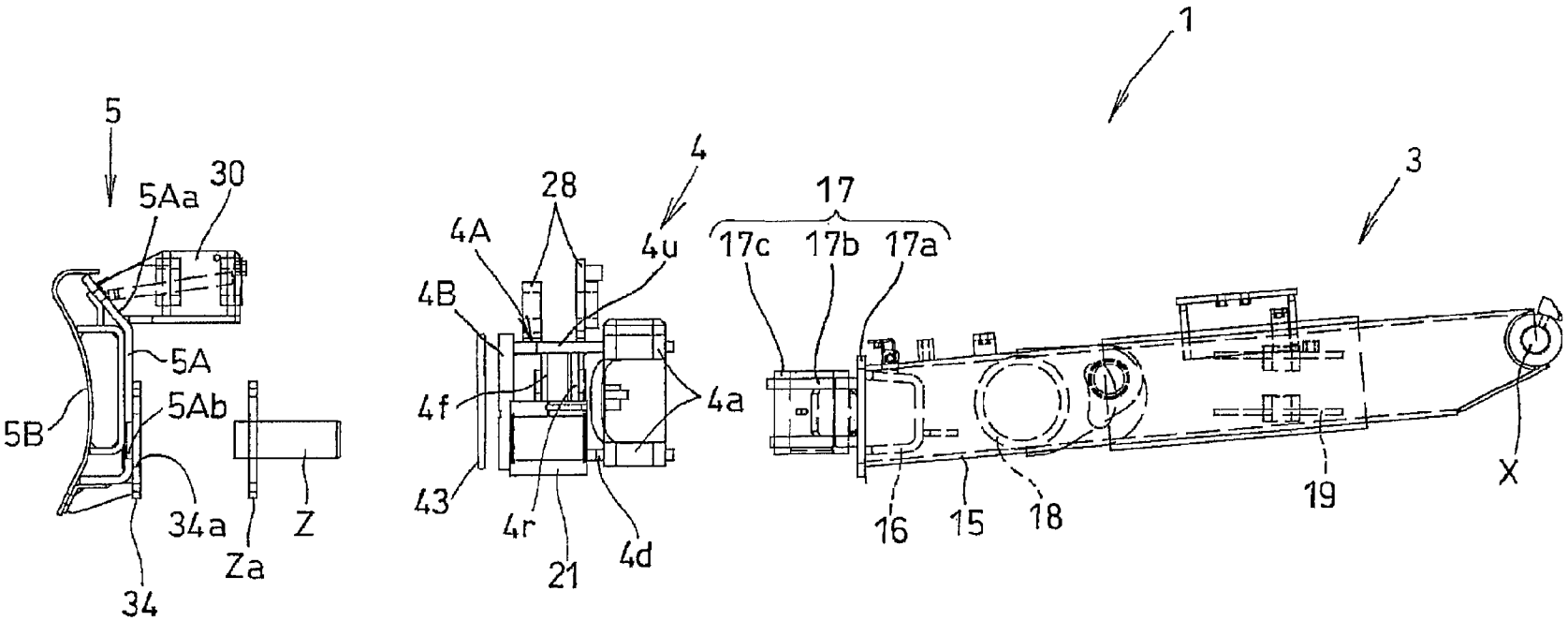
FIG. 7 is an exploded side view.
Figure 8:
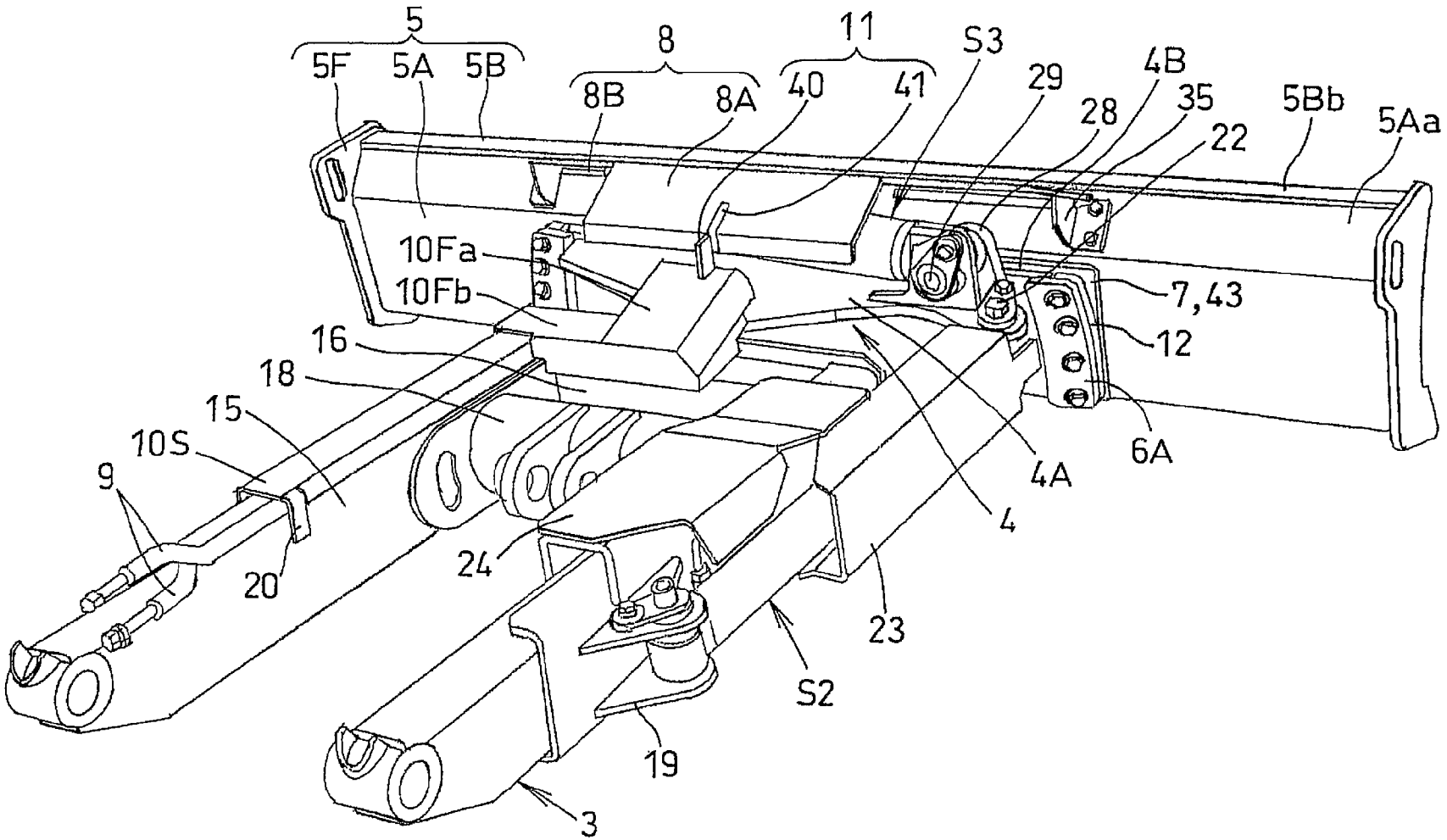
FIG. 8 is a general perspective view seen from the rear upper side.

As shown in FIG. 5, when the blade 5 is placed horizontal, the tilt cylinder S3 is inclined to place the cylinder rod S3*a* upward and a centerline K interconnecting the fore/aft shaft Z and the connecting pin 31 is inclined to the left side as seen in the rear view. The internal angle L formed between the tilt cylinder S3 and the centerline K is smaller than the right angle, but as the fore/aft shaft Z is disposed lower than the vertical center of the blade 5, the internal angle L is greater than when the fore/aft shaft Z is disposed upward. Further, as the horizontal distance from the axis YP of the vertical shaft Y to the connecting pin 31 is shorter than that to the base shaft 29, the internal angle L can be rendered closer to the right angle and the pivotal angle about the base shaft 29 can be rendered smaller also. As a result, the expansion/contraction force of the tilt cylinder S3 can be transmitted to the blade 5 in an efficient manner. Further, if the internal angle L is rendered closer to the right angle, the vertical pivotal motion of the tilt cylinder S3 at the time of tilt-pivoting operation is made smaller, so that movement of the hydraulic hose 9 can be made smaller.

Figure 9:
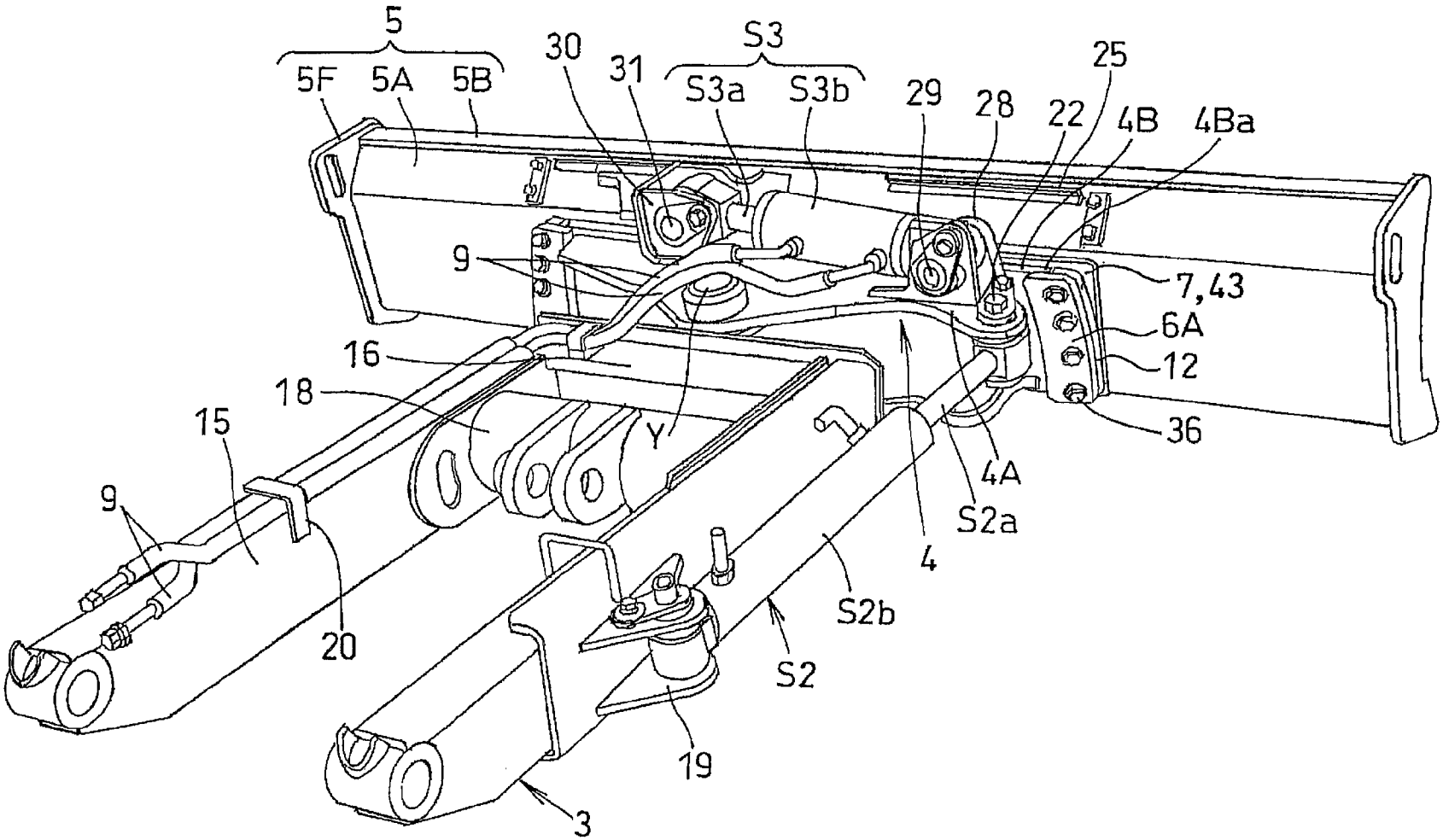
FIG. 9 is a general perspective view seen from the rear upper side, with removal of covers.
Figure 10:
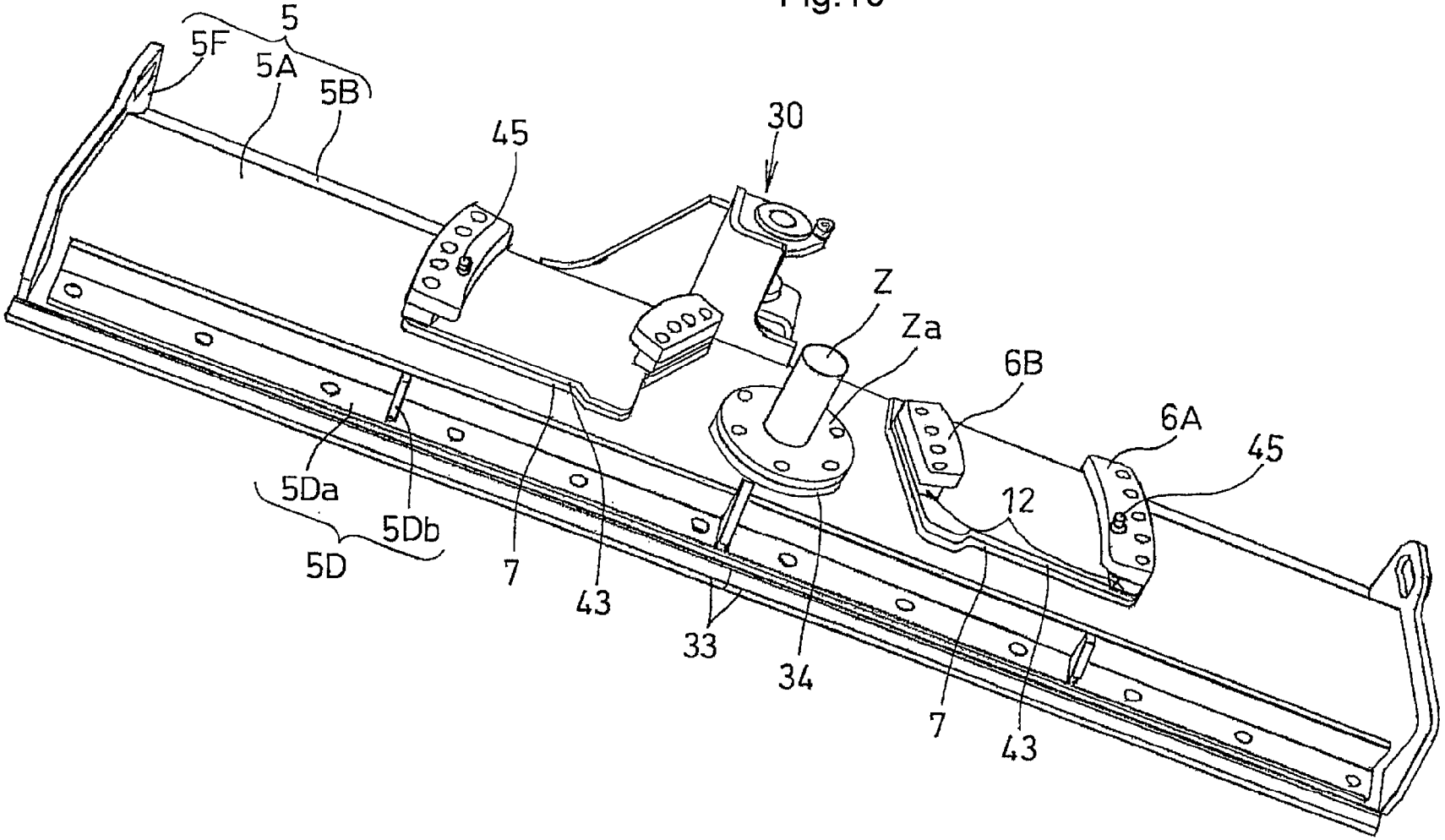
FIG. 10 is a perspective view showing the blade as seen from the rear lower side thereof.

The hydraulic hose 9 connected to the cylinder tube S3*b* of the tilt cylinder S3, as shown in FIG. 9, is extended to pass above the vertical shaft Y and in the right/left direction, above the lateral portion (left main member 15) of the dozer frame 3 on the opposite side to the disposing side (right side) of the cylinder tube S3*b*. Hence, as there is provided sufficient distance from above the lateral side of the dozer frame 3 to the cylinder tube S3*b*, the hydraulic hose 9 can be curved gently.

In FIGS. 1 through 11, the blade 5 includes a rear face body 5A supported to the fore/aft shaft Z and a blade main body 5B fixed to the front face of the rear face body 5A and covering, with its upper portion, the upper edge of the rear face body 5A. The rear face body 5A and the blade main body 5B are reinforced by a middle reinforcing member 5C having a one-side open square shaped cross section and disposed therebetween for reinforcing the interconnection thereof, a lower reinforcing member 5D for interconnecting and reinforcing the lower ends of the rear face body 5A and the blade main body 5B, and an upper reinforcing member 5E for interconnecting and reinforcing the upper ends of the rear face body 5A and the blade main body 5B. And, to right/left side ends of the rear face body 5A, the blade main body 5B, the middle reinforcing member 5C, the lower reinforcing member 5D and the upper reinforcing member 5E, side plates 5F are fixedly attached.

To the lower front face of the blade main body 5B, blade edges 33 are detachably attached. The blade edges 33 are provided as right/left plural parts (two separate parts), with each being detachably fixed via a fastener such as a bolt, a flush bolt, etc. that extends through the lower part of the blade main body 5B and the lower reinforcing member 5D. The blade edge 33 is used with one lateral edge thereof as the lower edge. When frictionally worn, the edge can be used with vertical reversal thereof, i.e. the other side edge being used instead.

The blade edge 33 has its lower edge projecting downwardly of the lower edge of the blade main body 5B so as to act as a member coming into contact with the ground surface to scrape off an amount of earth. Referring to the lower reinforcing member 5D, a plurality of ribs 5Db are provided in right/left spaced arrangement on a rear face of a plate member 5Da having a dogleg shaped cross section (substantially L-shaped cross section) and in FIG. 2, an additional rib 5Dc is fixed to each of the ribs 5Db.

The additional rib 5Dc shown in FIG. 2 has its lower end projecting downward from the lower edges of the plate member 5Da and the blade main body 5B and is placed in contact with the rear face of the blade edge 33. Hence, even if the lower edge of the blade edge 33 projects more downward than the lower edge of the blade main body 5B, the lower end of the additional rib 5*dc* provides a "backup".

The additional rib 5Dc can be welded or bolt-fastened to the rib 5Db. With the backup provided by this additional rib 5Dc, the lower edge of the blade edge 33 is allowed to project significantly downward from the lower edge of the blade main body 5B.

Alternatively, the lower portion of the rib 5Db per se can be extended downward, like the additional rib 5Dc, so that this extended lower end provides a backup for the lower end of the blade edge 33.

In the blade main body 5B, its front face is formed as an arcuate recessed face having the horizontal axial line as the center of curvature thereof and at the upper portion thereof, there is formed an upper portion 5Bb formed horizontal via a curved portion 5Ba. And, this horizontal upper portion 5Bb is disposed in an overlapping arrangement to cover a forwardly inclined upper portion 5Aa of the rear face body 5A.

At a lower portion at the right/left center of the rear face body 5A of the blade 5, there is fixedly attached a seat plate 34, as shown in FIGS. 2, 7, 9 and 10. And, this seat plate 34 and the rear face body 5A form a through hole 34*a* and a support hole 5Ab, respectively.

The fore/aft shaft Z includes an attaching flange Za on the front side thereof and this attaching flange Za is bolt-fastened to the seat plate 34. The front end of the fore/aft shaft Z extends through the through hole 34*a* to be supported within the support hole 5Ab.

Therefore, the fore/aft shaft Z is fixed to the rear face body 5A to project rearward therefrom and is pivotally supported to the fore/aft shaft receiving member 21 of the support body 4.

The rod support body 30 connecting the leading end of the cylinder rod S3*a* of the tilt cylinder S3 is fixed to the forwardly inclined upper portion 5Aa of the rear face body 5A and projects rearward from the rear face body 5A by an approximately same amount as the fore/aft shaft Z, so that the cylinder rod S3*a* and the fore/aft shaft Z can be disposed in an intersecting manner as seen in plan view.

In FIGS. 1-4 and 8, to the upper portion 5Aa of the rear face body 5A, there is attached a cover member 8 for covering the upper side of the tilt cylinder S3. A center cover portion 8A of this cover member 8 as a portion having a chevron shape in the side view, having a raised fore/aft intermediate portion and is bolt-fastened to the upper portion 5Aa via stays 35 provided at the opposed ends.

The cover member 8 includes a center cover portion 8A for covering the tilt cylinder S3, and an extension cover portion 8B extending from the center cover portion 8A and covering from above the right/left sliding portions 4B and right/left inner and outer guide members 6 to be described later.

A front edge 8*a* of the cover member 8 is disposed rearwardly of the upper portion 5Aa and downwardly of the horizontal upper portion 5Bb of the blade main body 5B. At the upper portion 5Aa, there is provided a receiving member 25 for receiving the front edge 8*a*. This receiving member 25 comprises a band plate formed into a V-shaped cross section and is formed longer than the right/left guide member 6. The receiving member 25 serves to prevent dropping of earth or sand from the front edge 8*a* onto the side of the guide member 6 and serves also to prevent deformation of the cover member 8.

The cover member 8 is constructed such that even when an obstacle if any rides over the upper end of the blade main body 5B, the protection by the horizontal upper portion 5Bb of the blade main body 5 prevents such obstacle from colliding the front edge 8*a*. The cover member 8 will be less damaged if an obstacle collides with the ridge portion formed at the intermediate portion of the member 8 than if the obstacle collides with the front edge 8*a*.

The center cover portion 8A of the cover member 8 projects rearward to the vicinity of the vertical shaft Y, and the front member 16 of the dozer frame 3 includes a front hose cover 10F for covering the hydraulic hose 9 in opposition to this center cover portion 8A. The front hose cover 10F includes a center portion 10Fa for covering from above the vertical shaft Y and a side portion 10Fb extending laterally from the center portion 10Fa to be connected to the side hose cover 10S.

At the front end of the center portion 10Fa of the front hose cover 10F, there is provided a raised marker 40. In opposition to this raised marker 40, at the right/left center of the center cover portion 8A of the cover member 8, there is provided an index marker 41. These raised marker 40 and index marker 41 together constitute an angle indicator 11. The center cover portion 8A is located upwardly of the center portion 10Fa, so as to avoid collision, even in an angle-pivoting operation thereof.

The angle indicator 11 is disposed in a plane substantially passing the respective axes YP, ZP of the vertical shaft Y and the fore/aft shaft Z. The raised marker 40 projects parallel with the axis YP of the vertical shaft Y and upwardly of the vertical shaft Y. The index marker 41 includes a vertical portion 41*a* disposed forwardly of the raised marker 40 and in parallel with the axis YP of the vertical shaft Y and an inclined portion 41*b* inclined forwardly and upwardly from the upper edge of this vertical portion 41*a*.

With the angle indicator 11 in operation, in association with a right/left pivotal movement (angle-pivoting operation) of the blade 5 about the vertical shaft Y, the inclined portion 41*b* of the index marker 41 pivots about the raised marker 40, so that based on the angle of this pivotal movement in plan view, the angle-pivotal movement angle can be detected. Whereas, in association with a vertical pivotal movement (tilt-pivoting operation) of the blade 5 about the fore/aft shaft Z, the vertical portion 41*a* and the inclined portion 41*b* of the index marker 41 pivot to collapse from the raised marker 40, so that based on the angle of this pivotal movement in the rear side view (as seen from the side of the traveling machine body 2), the tilt-pivoting angle can be detected.

Alternatively, if the index marker 41 is formed only of the vertical portion 41*a*, only the angle-pivoting angle will be detected. Or, if the index marker 41 is formed only of the inclined portion 41*b*, or if this portion is formed to extend horizontally, only the tilt angle will be detected. Advantageously, the raised marker 40 and the index marker 41 of the angle indicator 11 can be formed with colors different from each other or with different color(s) than those of the cover member 8 and the front hose cover 10F for facilitating visual distinction thereof.

In FIGS. 1-13, to the rear face of the blade 5, there are fixedly attached a pair of right/left base plates 7 relative to the fore/aft shaft Z at the right/left center. To the surface of each right/left base plate 7, a slide plate 43 is disposed and there is provided a guide member 6 for restricting forward departing displacement of the blade 5 while allowing relative vertical pivotal movement relative to the sliding portion 4B at the leading end of the arm portion 4A.

The slide plate 43 is clamped or bound between the base plate 7 and the guide member 6 and fastened together with the guide member 6. The slide plate 43 is placed in face contact with the sliding portion 4B for providing a backup therefor and transmits a pushing force when the blade 5 is to be advanced.

The guide member 6 includes, on the base plate 7 corresponding thereto, an outer peripheral guide element 6A engageable with an outer peripheral edge 4Ba of the sliding portion 4B in the radial direction of the fore/aft shaft Z and an inner peripheral guide element 6B engageable with the inner peripheral edge 4Bb of the sliding portion 4B.

The outer peripheral guide element 6A and the inner peripheral guide element 6B are detachably fixed by bolts (fasteners) 36 each via a spacer 12 having a substantially same thickness as the sliding portion 4B. The inner peripheral portion of the outer peripheral guide element 6A projects more radially inward than the spacer 12 and the outer peripheral portion of the inner peripheral guide element 6B projects more radially outward than the spacer 12 and each projecting portion slidably engages the sliding portion 4B so as to restrict forward departing displacement of the blade 5.

The inner and outer peripheral portions of the sliding portion 4B, the inner peripheral portions of the outer peripheral guide element 6A and its spacer 12 and the outer peripheral portions of the inner peripheral guide 6B and its spacer 12 are formed in the form of arc having the fore/aft shaft Z at the center of its curvature. Further, the vertical centers of the sliding portion 4B and the outer peripheral guide element 6A are disposed higher than the axis ZP of the fore/aft shaft Z.

With the dozer apparatus 1 for use with a backhoe, the sliding portion 4B more tends to collide with the guide member 6 when the dozer apparatus 1 is used as an outrigger for effecting an excavating operation, than when it is tilt-pivoted. Then, if the vertical center of the guide member 6 were at substantially same height as the fore/aft shaft Z, upon contacting of the blade 5 with the ground surface, the guide member 6 would be inclined in the fore/aft direction relative to the sliding portion 4B due to mechanical looseness or the like, so that uneven contacts would occur at upper/lower parts of the sliding portion 4B. As a result, local fatigue (or frictional wear) would occur at the upper/lower ends of the guide member 6, thus inviting reduction in the durability.

On the other hand, if the axis ZP of the fore/aft shaft Z is set sufficiently lower than the vertical center of the guide member 6 as described above, the contacting of the guide member 6 with the sliding portion 4B at the time of contacting of the blade 5 with the ground surface occurs in the same direction at the part upper than the fore/aft shaft Z, so that the contacting of the sliding portion 4B with the outer peripheral guide element 6A and with the inner peripheral guide element 6B will be nearly entire-surface contact, so that uneven contact (or frictional wear) can be reduced and the durability can be improved.

Further, if the fore/aft shaft Z is disposed forwardly of the vertical shaft Y and at a low position, it is possible to reduce the vertical height of the support body 4 so as to allow the tilt cylinder S3 to be disposed upwardly thereof. As a result, sufficient distance can be secured from the fore/aft shaft Z to the connecting pin 31, whereby the acting force of the tilt cylinder S3 can be transmitted in an efficient manner and at the same time, the support body 4 and the tilt cylinder S3 can be accommodated and confined substantially within the vertical dimension of the blade 5. Hence, the field of view from the side of the traveling machine body 2 to the blade 5 or to the working situation forwardly of this blade 5 can be improved.

The right/left inner peripheral guide elements 6B are not disposed in right/left symmetry, but the side (left side) where the rod support body 30 is disposed is placed higher than the other side (right side). The upper end of the left inner peripheral guide element 6B is located at the substantially same height as the upper end of the left outer peripheral guide element 6A and the upper end of the right inner peripheral guide element 4B is located lower than the upper end of the right outer peripheral guide element 6A.

Attachment and detachment of the blade 5 and attachment and detachment of the inner peripheral guide element 6B relative to the support body 4 are carried out under a condition where the tilt cylinder S3 is removed and the fore/aft shaft Z is supported to the support body 4 to be pivotable.

As shown in FIGS. 3, 5 and 10-13, the slide plate 43 is a metal plate having a similar shape to the base plate 7. At the center of its face in slidable contact with the sliding portion 4B, there is formed a lubricant oil passage M and on the opposed sides of the inner peripheral side and the outer peripheral side, there are formed a plurality of bolt holes 43*a* through which bolts 36 are to extend.

The bolt hole 43*a* formed at a vertical intermediate portion of on the inner peripheral side is formed as an elongate slot, so that dimensional error if any relative to the bolt 36 can be effectively absorbed when the right/left side plates 43 are attached vice versa.

The lubricant oil passage M includes a horizontal groove Ma having a length substantially over the entire right/left width at the vertical intermediate portion and an intersecting groove Mb intersecting this horizontal groove Ma and receives supply of oil from a first oil supply member 44. This first oil supply member 44 is a grease nipple which is provided in the sliding portion 4B of the support body 4 in correspondence with the intersecting groove Mb. The first oil supply member 44 is constructed such that even when the blade 5 is tilt-pivoted relative to the support member 4, the first oil supply member 44 can still feed an amount of oil from the intersecting groove Mb to provide lubricant oil (grease) to the horizontal groove Ma, so that the entire surface of the slide plate 43 can be lubricated.

Incidentally, although the intersecting groove Mb is formed as a straight groove having a greater width than the horizontal groove Ma, this may alternatively be formed as an arcuate groove centering about the fore/aft shaft Z with a same or smaller width as/than the horizontal groove Ma.

The guide member 6 includes a second oil supply member 45 for supplying oil between the outer peripheral guide element 6A and the sliding portion 4B outer periphery. This second oil supply member 45 too is a grease nipple and by forming a lubricant oil passage in the inner face of the outer peripheral guide element 6A in slidable contact with the sliding portion 4B, lubricating oil (grease) can be supplied to the sliding face of the blade 5 slidable relative to the sliding portion 4B even when the blade 5 is tilt-pivoted.

In the above, the second oil supply member 45 is provided only in the outer peripheral guide element 6A, such member can be provided also in the inner peripheral guide element 6B to supply oil to the gap formed with the sliding portion 4B inner periphery.

The slide plates 43 are attached to the right/left sides of the blade 5 with the two plates 43 of identical shape placed in reverse in the front and rear faces thereof. If the lubricant oil passage M is formed by shallow grooves, such grooves need to be provided in both of front and rear faces of the slide plate 43 with front/rear symmetric shape. However, if it is to extend through the plate, the lubricant oil passages M can be formed at one time in the front and rear faces of the slide plate 43.

With this slide plate 43, if one side thereof has frictionally worn out, the front and rear faces can be reversed each other and attached in reverse to the right/left sides of the blade 5, so that unused other faces thereof can be used. Hence, both of front and rear faces can be used with the reversible attachment.

Figure 11:
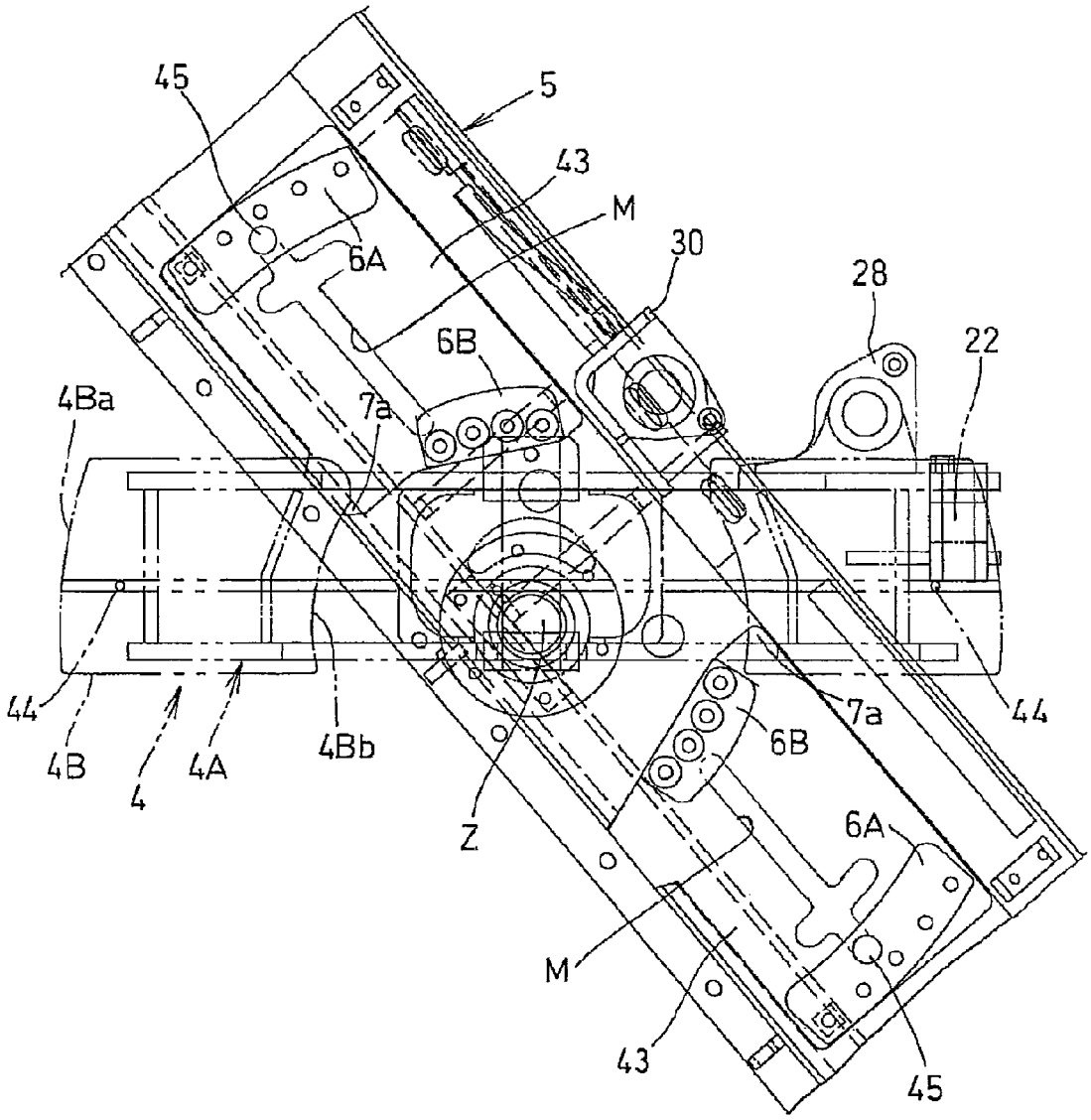
FIG. 11 is an explanatory view illustrating tilting movement of the blade when an inner peripheral guide element is attached/detached.
Figure 12:
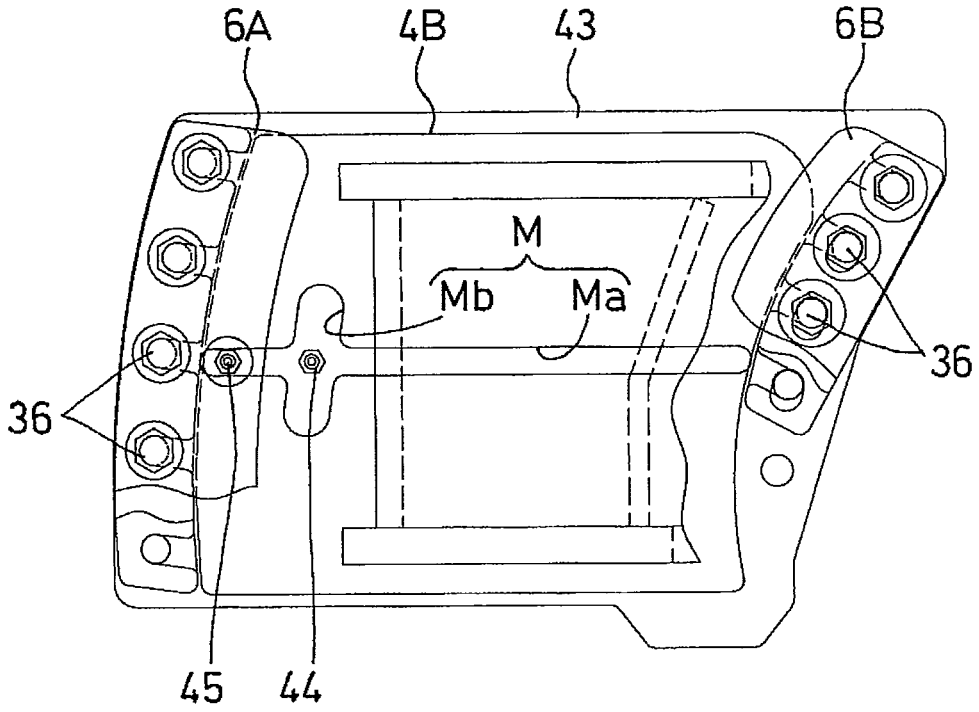
FIG. 12 is a rear view of a sliding portion with a slide plate and a guide member.
Figure 13:
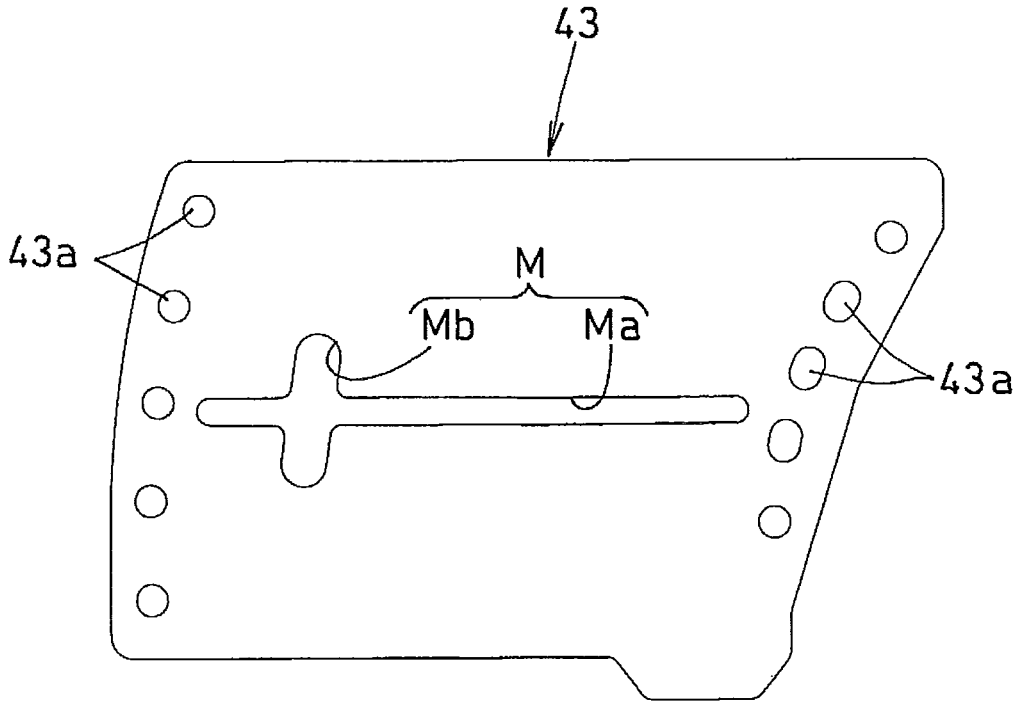
FIG. 13 is a rear view of the slide plate.

As shown in FIG. 11, the blade 5 is pivoted about the fore/aft shaft Z to assume an inclined posture relative to the support body 4. Under this condition, the engagement of the inner peripheral guide element 6B with the sliding portion 4B is released, whereby the blade 5 is attachable/detachable relative to the support body 4.

As the fore/aft shaft Z is located lower than the vertical center of the support body 4, one (right side) inner peripheral guide element 6B which is detached on the lower side of the sliding portion 4B and exposed from the support body 4 can be disposed at the vertical center of the base plate 7. Whereas, the other (left side) inner peripheral guide element 6B which is detached on the upper side of the sliding portion 4B needs to be disposed upwardly of the vertical center of the base plate 7 in order to be exposed from the support body 4.

When the pair of right/left slide plates 43, the outer peripheral guide elements 6A and the inner peripheral guide elements 6B are attached in advance to the rear face of the blade 5 and the fore/aft shaft Z is connected to be engaged with the sliding portion 4B of the support body 4, the inner peripheral guide element 6B (left side) need not be exposed from the support body 4. However, if the outer peripheral guide element 6B is to be replaced with keeping the fore/aft shaft Z connected to the support body 4, attachment/detachment is not possible unless the bolt 36 fastening the inner peripheral guide element 6B can be seen from the rear side. Therefore, it is necessary for the inner peripheral guide element 6B to be exposed from the support body 4, by pivoting the blade 5 relative to the support body 4 about the fore/aft shaft Z to be rendered into the inclined posture.

Each one of the right/left outer peripheral guide elements 6A and inner peripheral guide elements 6B can be used at its attached position with front and rear sides thereof reversed and can be replaced with changing its position between the right/left sides. Hence, even if uneven or one-sided contact occurs relative to the sliding portion 4B, each member can be used four times.

The base plate 7 includes a position setting portion 7*a* for setting the fore/aft position of the sliding portion 4B of the support body 4 relative to the base plate 7 when the support body 4 has been pivoted until the inner peripheral guide element 6B becomes exposed from the support body 4.

The rod support body 30 is offset from the right/left center of the rear face body 5A to the opposite side (left side) to the cylinder tube S3*b* disposing side. As this rod support body 30 projects to above the support body 4, the blade 5 cannot be pivoted to the offset side (counterclockwise in FIG. 11) relative to the support body 4 and cannot be pivoted by a large angle unless being pivoted to the counter-offset side (clockwise in FIG. 11). Further, so as to allow large inclination of the blade 5, the rod support body 30 is disposed with an offset to one side (left side) from the right/left center of the rear face body 5A.

With significant inclination of the blade 5, the sliding portion 4B becomes disengaged from the base plate 7 and the slide plate 43. Upon this disengagement, the base plate 7 and the slide plate 43 move rearward, so that there arises the possibility of collision of the base plate 7 and the slide plate 43 with the sliding portion 4B at the time of the inclination. However, by providing the above-described position setting portion 7*a* at the inner peripheral lower portions of the left base plate 7 and slide plate 43 and/or at the inner peripheral upper portions of the right base plate 7 and slide plate 43, disengagement of the sliding portion 4B from the base plate 7 and the slide plate 43 can be prevented.

With the dozer apparatus relating to the present invention in operation, when the angle cylinder S2 is operated, the support body 4 is pivoted in the fore/aft direction (angle-pivoted) about the vertical shaft Y. When the tilt cylinder S3 is operated, the blade 5 is pivoted vertically (tilt-pivoted) about the fore/aft shaft Z.

The tilt cylinder S3 is disposed between the rear face body 5A of the blade 5 and the support body 4. The cover member 8 for covering the tilt cylinder S3 from above is provided in the rear face body 5A and the upper portion of the blade main body 5B has a shape for covering the upper edge of the rear face body 5A. Then, with utilization of this shape, the front edge 8*a* of the cover member 8 is disposed downwardly of the upper portion 5Ba of the blade main body 5B, so that an obstacle may collide with the upper portion 5Ba of the blade main body 5B, but not collide with the front edge 8*a* of the cover member 8.

During the tilt-pivoting operation by the tilt cylinder S3, the sliding portions 4B provided at the leading ends of the right/left arm portions 4A of the support body 4 are in engagement with the guide member 6 while allowing the relative vertical sliding movement of the blade 5, so that the blade 5 can be supported with good balance in the right/left direction.

The cover member 8 includes the extension cover portion 8B extended from the center cover portion 8A and covers the sliding portion 4B and the right/left guide members 6 from above, thus preventing dropping of sand/earth onto the engaging portions. Further, at the upper portion 5Aa of the rear face of the blade 5, there is provided the receiving member 25 for receiving the front edge 8*a* of the cover member 8. This receiving member 25 serves also to prevent deformation of the cover member 8.

The cover member 8 extends rearward to the vicinity of the vertical shaft Y and adjacent the vertical shaft Y of the dozer frame 3, there is provided the hose cover 10 for covering the hydraulic hose 9 extending to the tilt cylinder S3. And, between this hose cover 10 and the cover member 8, the angle indicator 11 is provided. Hence, the angle-pivoting angle and/or the tilt-pivoting angle of the blade 5 can be displayed.

By disposing this angle indicator 11 on the plane extending substantially through the axes of the vertical shaft Y and the fore/aft shaft Z, the angle-pivoting angle and/or the tilt-pivoting angle can be displayed more accurately.

Therefore, damage of the cover member for the tilt cylinder can be readily prevented by the blade.

When the angle cylinder S2 is operated, the support body 4 is pivoted in the fore/aft direction (angle-pivoted) about the vertical shaft Y. When the tilt cylinder S3 is operated, the blade 5 is pivoted vertically (tilt-pivoted) about the fore/aft shaft Z.

In the tilt cylinder S3, the leading end of the cylinder rod S3*a* is connected to the blade 5 upwardly of the fore/aft shaft Z and the bottom of the cylinder tube S3*b* is farther from the fore/aft shaft Z than the cylinder rod S3*a* and connected to the arm portion 4A projecting outward in the right/left direction of the support body 4. The internal angle formed by the axis of the angle cylinder S2 with the centerline interconnecting the fore/aft shaft Z and the connecting point at the leading end of the cylinder rod S3*a* is greater than that formed in the case when the cylinder rod s3*a* is farther from the fore/aft shaft Z than the bottom of the cylinder tube S3*b*, so that the expansion/contraction force of the angle cylinder S2 can be applied in an efficient manner.

The fore/aft shaft Z is disposed immediately before the lower portion of the vertical shaft Y and the tilt cylinder S3 is disposed immediately above the fore/aft shaft Z. Hence, the fore/aft shaft Z, the vertical shaft Y and the tilt cylinder S3 can be disposed in a compact manner with respect to the fore/aft direction and the vertical direction, and the cylinder expansion/contraction force for effecting the tilt-pivoting operation of the blade 5 about the fore/aft shaft Z can be transmitted in an efficient manner.

As the hydraulic hose 9 is extended above the lateral portion of the dozer frame 3 on the side remote from the cylinder tube S3*b*, the hydraulic hose 9 can form a large curve and the movement of the hydraulic hose 9 during the operation of the tilt cylinder S3 can be made smaller.

As the cylinder tube S3*b* of the tilt cylinder S3 is disposed away from the fore/aft shaft Z, the leading end of the cylinder rod S3*a* can be disposed closer to the fore/aft shaft Z.

Therefore, the expansion/contraction force of the tilt cylinder can be transmitted for the tilt-pivoting operation of the blade.

When the angle cylinder S2 is operated, the support body 4 is pivoted in the fore/aft direction (angle-pivoted) about the vertical shaft Y. When the tilt cylinder S3 is operated, the blade 5 is pivoted vertically (tilt-pivoted) about the fore/aft shaft Z. During this tilt-pivoting operation, the sliding portion 4B provided at the leading end of the right/left arm portion 4A of the support body 4 is in engagement with the guide member 6 while allowing vertical sliding movement of the blade 5. As each right/left sliding portion 4B is used not only on the outer peripheral side, but also on the inner peripheral side in the radial direction of the fore/aft shaft Z, wherein the outer peripheral side engages the outer peripheral guide element 6A provided in the rear face of the blade 5, while the inner peripheral side engages the inner peripheral guide element 6B. Whereby, against the acting force applied when the blade 5 is placed on the ground surface or when the vehicle travels backward with placing the blade 5 on the ground surface (the force tending to move the blade 5 forwardly away from the support body 4), the support body 4 can sufficiently support the blade 5 at the two, far and near positions in the radial direction of the fore/aft shaft Z.

The arm portions 4A and the sliding portions 4B of the support body 4 and the outer peripheral guide element 6A and the inner peripheral guide element 6B of the blade 5 are all provided in respective pairs pair on the right/left sides of the fore/aft shaft Z, so that the support body 4 supports the blade 5 with good right/left balance.

The outer peripheral guide element 6A is located on the outer peripheral side of the sliding portion 4B, so this element is not to be made invisible by the arm portion 4A of the support body 4. Whereas, the outer peripheral guide element 6B is overlapped with the arm portion 4A, thus being made invisible by the presence of the arm portion 4A. By disposing this inner peripheral guide element 6B at the position exposed from the support body 4 when the tilt cylinder S3 is detached and the blade 5 is vertically pivoted about the fore/aft shaft Z, attachment/detachment of the inner peripheral guide element 6B is made possible from the rear face side of the blade 5, even under the condition of the blade 5 being pivotally supported to the support body 4.

To the base plate 7 fixed to the rear face of the blade 5, the outer peripheral guide elements 6A and the inner peripheral guide elements 6B are detachably fixed. And, this base plate 7 includes the position setting portion 7*a*. Therefore, even when the support body 4 has been pivoted until the inner peripheral guide element 6B becomes exposed from the support body 4, it is still possible to prevent displacement of the fore/aft position of the sliding portion 4B of the support body 4 relative to the support body 4.

Therefore, the blade can be supported more reliably not only at its outer end portion, but also at its intermediate portion by the support body 4.

When the tilt cylinder S3 is operated, the blade 5 is pivoted vertically (tilt-pivoted) about the fore/aft shaft Z. During this tilt-pivoting operation, the sliding portion 4B provided at the leading end of the right/left arm portion 4A of the support body 4 is in engagement with the guide member 6 while allowing vertical sliding movement of the blade 5.

As the sliding portion 4B is used not only on the outer peripheral side, but also on the inner peripheral side, in the radial direction of the fore/aft shaft Z, and the outer peripheral side engages the outer peripheral guide element 6A provided in the rear face of the blade 5 and the inner peripheral side engages the inner peripheral guide element 6B. Whereby, against the acting force applied when the blade 5 is placed on the ground surface or when the vehicle travels backward with placing the blade 5 on the ground surface (the force tending to move the blade 5 forwardly away from the support body 4), the support body 4 can sufficiently support the blade 5 at the two, far and near positions in the radial direction of the fore/aft shaft Z.

The arm portions 4A and the sliding portions 4B of the support body 4 and the outer peripheral guide elements 6A and the inner peripheral guide elements 6B of the blade 5 are all provided in respective pairs on the right/left sides of the fore/aft shaft Z, so that the support body 4 supports the blade 5 with good right/left balance.

The base plate 7 fixed to the rear face of the blade 5 includes the slide plate 43 which comes into sliding contact with the sliding portion 4B of the support body 4. So that, the frictional resistance between the support body 4 and the blade 5 can be reduced. And, this slide plate 43 is detachably fixed with the bolts 36 fastening the guide member 6, i.e. the outer peripheral guide element 6A and the inner peripheral guide element 6B, together with these. So that, even when the slide plate 43 is frictionally worn through the sliding contact with the sliding portion 4B, this can be easily replaced or repaired by removing this plate 43 together with the guide member 6.

As the lubricant oil passage M is formed in the slide plate 43, the sliding contact with the sliding portion 4B of the support body 4 can proceed smoothly, and oil supply to the lubricant oil passage M can be effected from the sliding portion 4B side of the support body 4 via the first oil supply member 44. Further, oil supply between the guide member 6 and the arm portion 4A can be done from the guide member 6 side via the second oil supply member 45.

The arm portions 4A of the support body 4, the slide plates 43 and the guide members 6 of the blade 5 are provided in respective pairs on the right/left of the fore/aft shaft Z, and the slide plates 43 can be attached in reverse on the right/left sides, with reversal of the front and rear faces thereof. With this, even when uneven frictional wear has occurred in the surface of the slide plate 43, with reversal of the front and rear faces, the rear face can be used on the other right/left side. Thus, with such use of both front and rear faces, cost reduction is made possible.

Therefore, the frictional resistance between the support body and the blade can be reduced and the repair can be carried out readily.

In embodying the present invention, as to the shapes of the respective members and the positional relationships in the fore/aft, right/left and vertical directions thereof, these are best when embodied as illustrated in FIGS. 1-13. However, the present invention is not limited to the foregoing embodiment, but the members and constructions/arrangements can vary in many ways and combinations too can be changed.

For instance, in the foregoing embodiment, the dozer apparatus 1 was illustrated as a tilt/angle dozer apparatus. However, the apparatus can be a tilt dozer apparatus without the vertical shaft Y or angle cylinder S2.

In case of the tilt/angle dozer apparatus, the angle cylinders S2 can be provided on the right/left sides of the dozer frame 3, so that the pair of right/left cylinders angle-pivot the support body 4.

The arm portion 4A and the sliding portion 4B of the support body 4 and the guide member 6 of the blade 5 may be provided only on one of the right/left sides. However, providing them in respective pairs both on the right/left sides is preferred since it achieves good right/left balance.

For instance, the angle cylinders S2 can be provided on the right/left sides of the dozer frame 3, so that the pair of right/left cylinders angle-pivot the support body 4.

The tilt cylinder S3 may alternatively be disposed such that the connecting pin 31 of the cylinder rod S3*a* is located farther from the fore/aft shaft Z than the base shaft 29 of the cylinder tube S3*b*.

If the outer peripheral guide element 6A alone of the guide member 6 is provided with omission of its inner peripheral guide element 6B, this arrangement will enable attachment/detachment of the outer peripheral guide element 6A with the blade 5 being kept attached to the support body 4, so that detachment of the inner peripheral guide element 6B becomes unnecessary. Therefore, the rod support body 30 may be disposed at the right/left center of the blade 5 and the leading end of the cylinder rod S3*a* of the tilt cylinder 3 may be disposed immediately above the fore/aft shaft Z.

Further, in the foregoing embodiment, there was described the case where the slide plate 43 is provided on the surface of each one of the right/left base plates 7. Instead, the slide plates 43 need not be provided necessarily.

Industrial Applicability

The present invention can be used as a dozer apparatus for a work machine.

What is claimed is:

1. A dozer apparatus comprising:

a dozer frame supported to a traveling machine body to be pivotable about a horizontal shaft, the dozer frame being vertically movable by a dozer cylinder;

a support body supported to the dozer frame to be pivotable about a vertical shaft, the support body being pivotable in a fore/aft direction by an angle cylinder; and a blade supported to the support body to be pivotable about a fore/aft shaft, the blade being vertically pivotable by a tilt cylinder;

the support body supporting the fore/aft shaft downwardly and forwardly of the vertical shaft; and the tilt cylinder being disposed upwardly and forwardly of the vertical shaft and also upwardly of the fore/aft shaft, wherein the support body includes arm portions projecting outward in a right/left direction and a sliding portion provided at the leading end of each arm portion and facing the blade;

in a rear face of the blade there is provided a guide member that restricts forward departing movement of the blade while allowing vertical pivoting movement of the blade relative to the sliding portion;

the fore/aft shaft has an axis set lower than a vertical center of the sliding portion;

the guide member includes an outer peripheral guide element engageable with an outer peripheral part of the sliding portion in a radial direction of the fore/aft shaft and an inner peripheral guide element engageable with an inner peripheral part of the sliding portion; and the inner peripheral guide element is disposed at such a position relative to the blade that the inner peripheral guide element becomes exposed from the support body to be attachable/detachable when the tilt cylinder is detached and the blade is vertically pivoted about

2. The dozer apparatus according to claim 1, wherein:

the blade includes a rear face body supported to the fore/aft shaft and a blade main body fixed to a front face of the rear face body and covering an upper edge of the rear face body;

the tilt cylinder is disposed between the rear face body and the support body, and downwardly of an upper end of the blade main body; and to the rear face body, there is attached a cover member for covering the tilt cylinder from above, with a front edge of the cover member being disposed downwardly of an upper portion of the blade main body.

3. A dozer apparatus comprising:

a dozer frame supported to a traveling machine body to be pivotable about a horizontal shaft, the dozer frame being vertically movable by a dozer cylinder;

a support body supported to the dozer frame to be pivotable about a vertical shaft, the support body being pivotable in a fore/aft direction by an angle cylinder; and a blade supported to the support body to be pivotable about a fore/aft shaft, the blade being vertically pivotable by a tilt cylinder;

the support body supporting the fore/aft shaft downwardly and forwardly of the vertical shaft; and the tilt cylinder being disposed upwardly and forwardly of the vertical shaft and also upwardly of the fore/aft shaft, wherein the support body includes arm portions projecting outward in a right/left direction and a sliding portion provided at the leading end of each arm portion and facing the blade;

in a rear face of the blade, there is provided a guide member that restricts forward departing movement of the blade while allowing vertical pivoting movement of the blade relative to the sliding portion;

the fore/aft shaft has an axis set lower than a vertical center of the sliding portion;

to a rear face of the blade, a slide plate in slidable contact with the sliding portion of the support body is provided to be attachable/detachable to/from the guide member;

the guide member includes an outer peripheral guide element engageable with an outer peripheral part of the sliding portion in a radial direction of the fore/aft shaft and an inner peripheral guide element engageable with an inner peripheral part of the sliding portion; and the outer peripheral guide element and the inner peripheral guide element are fixed to the blade across the slide plate.

4. The dozer apparatus according to claim 3, wherein:

the slide plate defines a lubricant oil passage;

a first oil supply member for supplying oil to the lubricant oil passage is provided in the arm portion of the support body; and a second oil supply member for supplying oil between the guide member and the arm portion is provided in the guide member.

5. A dozer apparatus comprising:

a dozer frame supported to a traveling machine body to be pivotable about a horizontal shaft, the dozer frame being vertically movable by a dozer cylinder;

a support body supported to the dozer frame to be pivotable about a vertical shaft, the support body being pivotable in a fore/aft direction by an angle cylinder; and a blade supported to the support body to be pivotable about a fore/aft shaft, the blade being vertically pivotable by a tilt cylinder;

the support body supporting the fore/aft shaft downwardly and forwardly of the vertical shaft; and the tilt cylinder being disposed upwardly and forwardly of the vertical shaft and also upwardly of the fore/aft shaft, wherein the support body includes arm portions projecting outward in a right/left direction and a sliding portion provided at the leading end of each arm portion and facing the blade;

in a rear face of the blade, there is provided a guide member that restricts forward departing movement of the blade while allowing vertical pivoting movement of the blade relative to the sliding portion;

the fore/aft shaft has an axis set lower than a vertical center of the sliding portion; and the guide member includes an outer peripheral guide element engageable with an outer peripheral part of the sliding portion in a radial direction of the fore/aft shaft and an inner peripheral guide element engageable with an inner peripheral part of the sliding portion.

6. A dozer apparatus comprising:

a dozer frame supported to a traveling machine body to be pivotable about a horizontal shaft, the dozer frame being vertically movable by a dozer cylinder;

a support body supported to the dozer frame to be pivotable about a vertical shaft, the support body being pivotable in a fore/aft direction by an angle cylinder; and a blade supported to the support body to be pivotable about a fore/aft shaft, the blade being vertically pivotable by a tilt cylinder;

the support body supporting the fore/aft shaft downwardly and forwardly of the vertical shaft; and the tilt cylinder being disposed upwardly and forwardly of the vertical shaft and also upwardly of the fore/aft shaft, wherein the blade includes a rear face body supported to the fore/aft shaft and a blade main body fixed to a front face of the rear face body and covering an upper edge of the rear face body;

the tilt cylinder is disposed between the rear face body and the support body;

to the rear face body, there is attached a cover member for covering the tilt cylinder from above, with a front edge of the cover member being disposed downwardly of an upper portion of the blade main body;

the support body includes arm portions projecting outward in a right/left direction and a sliding portion provided at the leading end of each arm portion and facing the blade;

in a rear face of the blade, there is provided a guide member that restricts forward departing movement of the blade while allowing vertical pivoting movement of the blade relative to the sliding portion; and the cover member includes a center cover portion for covering the tilt cylinder, and an extension cover portion extending from the center cover portion and covering from above the right/left sliding portions and the right/left guide members.

* * * * *

UNITED STATES PATENT AND TRADEMARK OFFICE

CERTIFICATE OF CORRECTION

PATENT NO. : 8,678,103 B2
APPLICATION NO. : 12/922916
DATED : March 25, 2014
INVENTOR(S) : Shigeru Miyuki et al.

It is certified that error appears in the above-identified patent and that said Letters Patent is hereby corrected as shown below:

In the Claims

Column 16, Line 3, Claim 1, after "about" insert -- the fore/aft shaft --

Signed and Sealed this
Twenty-fourth Day of June, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,678,103 B2
APPLICATION NO. : 12/922916
DATED : March 25, 2014
INVENTOR(S) : Miyuki et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 368 days.

Signed and Sealed this
Twenty-ninth Day of September, 2015

Michelle K. Lee

Michelle K. Lee
*Director of the United States Patent and Trademark Office*